US006422048B1

(12) United States Patent
Fontes et al.

(10) Patent No.: US 6,422,048 B1
(45) Date of Patent: Jul. 23, 2002

(54) SNOWBOARD SECURITY LOCKS

(75) Inventors: Ross M. Fontes, Irvine; Rex O. Bare, Lake Forest; Jeffrey C. Smith, Newport Beach, all of CA (US)

(73) Assignee: Spoonfish, Inc., Irvine, CA (US)

( * ) Notice: Subject to any disclaimer, the term of this patent is extended or adjusted under 35 U.S.C. 154(b) by 0 days.

(21) Appl. No.: 09/574,718

(22) Filed: May 18, 2000

Related U.S. Application Data

(63) Continuation-in-part of application No. 09/268,903, filed on Mar. 15, 1999, now Pat. No. 6,230,526.

(51) Int. Cl.[7] ..... E05B 73/00

(52) U.S. Cl. ..... 70/58; 70/18; 70/30; 70/49; 70/233; 280/11.14; 280/601; 280/637; 280/611; 280/612; 280/619; 280/814; 280/809

(58) Field of Search ..... 70/18, 30, 49, 70/58, 233; 280/11.14, 601, 637, 611, 612, 619, 622, 623, 632, 633, 607, 618, 814, 809

(56) References Cited

U.S. PATENT DOCUMENTS

| | | | | |
|---|---|---|---|---|
| 3,023,022 A | | 2/1962 | Boyden | |
| 3,101,695 A | | 8/1963 | Honeyman | |
| 3,481,617 A | | 12/1969 | Salomon | |
| 3,670,535 A | * | 6/1972 | Stettner et al. | 70/58 |
| 3,714,803 A | | 2/1973 | Chenenko | |
| 3,990,713 A | | 11/1976 | Hokanson | |
| 3,999,410 A | | 12/1976 | Hall | |
| 4,082,306 A | | 4/1978 | Sheldon | |
| 4,231,586 A | | 11/1980 | Krause | |
| 4,340,376 A | | 7/1982 | Williams | |
| 4,458,907 A | | 7/1984 | Meredith | |
| 4,702,495 A | | 10/1987 | Roda | |
| 4,773,239 A | | 9/1988 | Lowe et al. | |
| 4,922,735 A | | 5/1990 | Leary | |
| 4,962,968 A | | 10/1990 | Caplin | |
| 4,970,883 A | | 11/1990 | Johnson | |
| 5,005,868 A | | 4/1991 | Stern | |
| 5,026,088 A | * | 6/1991 | Styart | 280/637 |
| 5,100,161 A | | 3/1992 | Tillyer | |
| 5,119,649 A | | 6/1992 | Spence | |
| 5,177,986 A | | 1/1993 | Jensen | |
| 5,179,847 A | | 1/1993 | Dorn | |
| 5,306,046 A | | 4/1994 | Stanley | |
| 5,362,087 A | * | 11/1994 | Agid | 280/611 |
| 5,522,620 A | | 6/1996 | Pracas | |
| 5,531,082 A | | 7/1996 | Wolk et al. | 70/63 |
| 5,564,719 A | * | 10/1996 | Kisselmann | 280/14.2 |
| 5,706,680 A | | 1/1998 | Wroble | |
| 5,711,539 A | | 1/1998 | Tang | |
| 5,749,251 A | | 5/1998 | Keefe | |

FOREIGN PATENT DOCUMENTS

| | | |
|---|---|---|
| CA | 961296 | 1/1975 |
| CH | 227612 | 6/1943 |
| DE | 24 00 979 | 7/1975 |
| DE | 2734212 | 2/1979 |
| FR | 1499959 | 9/1967 |
| FR | 2517215 | 11/1981 |
| FR | 2 529 991 | 3/1986 |
| GB | 173020 | 12/1921 |

*Primary Examiner*—William A. Cuchlinski, Jr.
*Assistant Examiner*—Ronnie Mancho
(74) *Attorney, Agent, or Firm*—Lyon & Lyon LLP

(57) ABSTRACT

There is disclosed herein relatively simple locking devices for sporting items such snowboards and the like. In one form of the locking device, the same includes a member which can be affixed to a binding of a snowboard, and includes a releasable cable which can be wrapped around a fixed or stationary object so as to secure the sporting item thereto for safe storage. In one embodiment, the cable is normally retained in a flanged section of a pad of the locking system, but can be released therefrom for attachment to the fixed or stationery object. In another embodiment, the cable can be retained around a boot binding assembly.

24 Claims, 24 Drawing Sheets

5,769,438 A 6/1998 Svetlov
5,820,155 A * 10/1998 Brisco ..... 280/607
5,855,390 A * 1/1999 Hassell ..... 280/607
5,901,588 A 5/1999 Frost
5,904,056 A 5/1999 Ozaki
6,024,375 A * 2/2000 Johnson ..... 280/601
6,059,315 A 5/2000 Selph
6,082,026 A * 7/2000 Sand et al. ..... 36/89
6,089,054 A * 7/2000 Stukas et al. ..... 70/18
6,196,569 B1 * 3/2001 Berger et al. ..... 280/607
6,230,526 B1 * 5/2001 Fontes et al. ..... 70/18

* cited by examiner

SNOWBOARD SECURITY LOCKS

This application is a continuation-in-part of application Ser. No. 09/268,903 filed Mar. 15, 1999, now U.S. Pat. No. 6,230,526, entitled "Security Locks," the disclosure of which incorporated here and by reference.

This invention relates to security devices, and more particularly to security locks for use on devices such as snowboards and the like.

BACKGROUND OF THE INVENTION

Snowboarding and snow skiing are all extremely popular sports today. Snowboarding, like skateboarding, is one of the fastest growing sports today. One out of every four persons who regularly visits ski resorts owns or rides a snowboard. Snowboarding is increasing globally both as a competitive sport as well as an alternative to conventional skiing. Snow skiing is still the most popular wintertime sport in the world today, but snowboarding is gaining.

Snowboards are relatively expensive. The need for protecting snowboards in today's increasingly crowded ski resorts is a must. As more and more people turn to snowboarding, the risk of theft is a growing concern.

Some people make use of steel cables with locks which can be used to secure these types of sporting equipment to some fixed object such as a secure pole. Unfortunately, these types of cable-lock devices must be carried by the person using the sporting equipment; for example, a snowboarder at the slopes has to physically carry the locking device, and the locking devices usually are bulky.

Ski resorts frequently have racks for skis, but which normally are not provided with any type of locking system, and such resorts generally have not yet addressed some type of rack for snowboards. As more and more people turn snowboarding, the risk of theft is a growing concern.

Therefore, there is a need for a reliable locking device. Some forms of locking devices have been devised as is evidenced by U.S. Pat. Nos. 4,773,239, 5,179,847, 5,177,986, 5,706,680. However, these devices either involve locking devices that must be carried on the person while the sporting equipment is in use, such as a separable lock device, or they involve relatively bulky or complicated devices.

A suitable locking device would allow the snowboarder protection against theft. The locking devices of the present invention offer the snowboarder the opportunity for protection.

Accordingly, it is a principal object of the present invention to provide a relatively simple locking device or system for sports equipment like snowboards.

A further object of the present invention is to provide a locking device for sports equipment, such as snowboards and the like, which does not require the person to carry a lock, cable or other separate locking device.

A further object of the present invention is to provide an improved security device for sports equipment.

The locking devices of the present invention will help deter a would-be thief from stealing snowboards and the like while the user has lunch, goes to the lodge, car, or any other situation would involve leaving their equipment behind for any length of time. The present locking concepts can provide the snowboarder the extra piece of mind by knowing their equipment is secure.

SUMMARY OF THE INVENTION

According to the present invention, a relatively simple and compact locking device is provided for snowboards and the like. In one embodiment, the device comprises a compact cable lock which can be mounted adjacent to the bindings attachment of a snowboard so as to be securely affixed to the sports item. A lock can include a releasable cable which is normally wrapped around a textured pad forming a "stomp pad," but which can be extended to lock around a fixed pole or other fixed or stationary object so as to secure the snowboard thereto. Other embodiments have different forms of cable lock assemblies. Same use key locks and some have combination locks.

BRIEF DESCRIPTION OF THE DRAWINGS

These and other objects and features of the present invention will become better understood through a consideration of the following description taken in conjunction with the drawings in which:

FIGS. 6*a* through 6*f* are views of another locking device for snowboards and the like;

" and FIGS. 8*a* and 8*b* are views of still another locking device for snowboards and the like.

DETAILED DESCRIPTION

Figure 1:
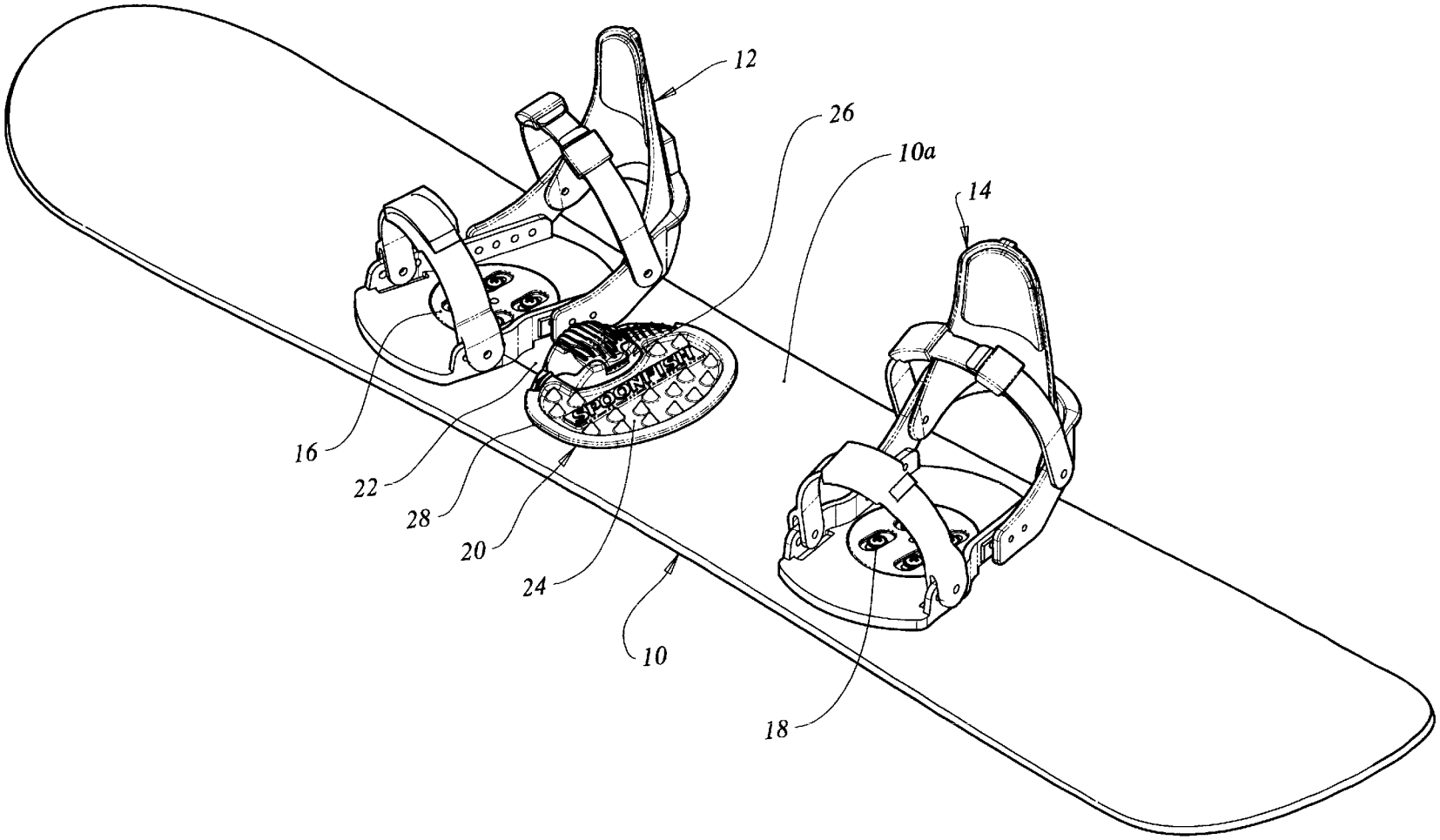
FIG. 1 is a partial perspective view of a snowboard and a first embodiment of a locking device according to the present invention for sporting equipment.

Turning now to the drawings, and first to FIG. 1, a typical snowboard 10 is shown having conventional boot bindings 12, 14 and respective associated bindings attachments 16 and 18. The bindings are adjustable as is know in the art to accommodate different snowboarders and snowboarder styles and boots.

According to an exemplary embodiment of the present invention, a snowboard security lock assembly 20 is provided which comprises a mounting plate 22 (note particularly FIG. 2*b*), textured pad 24 which can serve "stomp pad," lock assembly 26 (also note FIGS. 2*a*–2*e*) and cable 28. The mounting plate 22 has suitable holes 30 to enable the same to be mounted underneath the binding attachment 16 by the attachment mounting bolts 32 (note FIG. 2*b*). The holes 30 in the plate 22 can be discrete holes or elongated holes (e.g., 1 inch long) to fit with the standard binding mounting arrangement of snowboards.

The mounting plate 22 extends underneath the pad 24 and locking device 26 and covers the bottom of the locking device. The locking device 26 is secured to the plate 22 in any suitable form as by screw fasteners, rivets, spot welding, or the like, and the pad 24 typically is adhesively mounted, such as by a double faced adhesive, to the plate 22 and to the upper surface 10*a* of the snowboard 10. The pad preferably is formed from a resilient material such as a thermoplastic elastomer or urethane. The outer free end of the plate 22 preferably extends past the lock and is captured by the pad 24 to allow for board flex. The plate is thin to keep the locking device from moving or rattling.

The cable 28 is fixed at one end to the board 10 at a location underneath the pad 24 in any suitable manner. For example, one end can be permanently fixed to the plate 22 or lock assembly 26 or captured between the plate and lock housing. It also can be removable rather than permanently attached. This will be better understood in the discussion of FIGS. 2*d* and 2*e*.

Figure 2A:
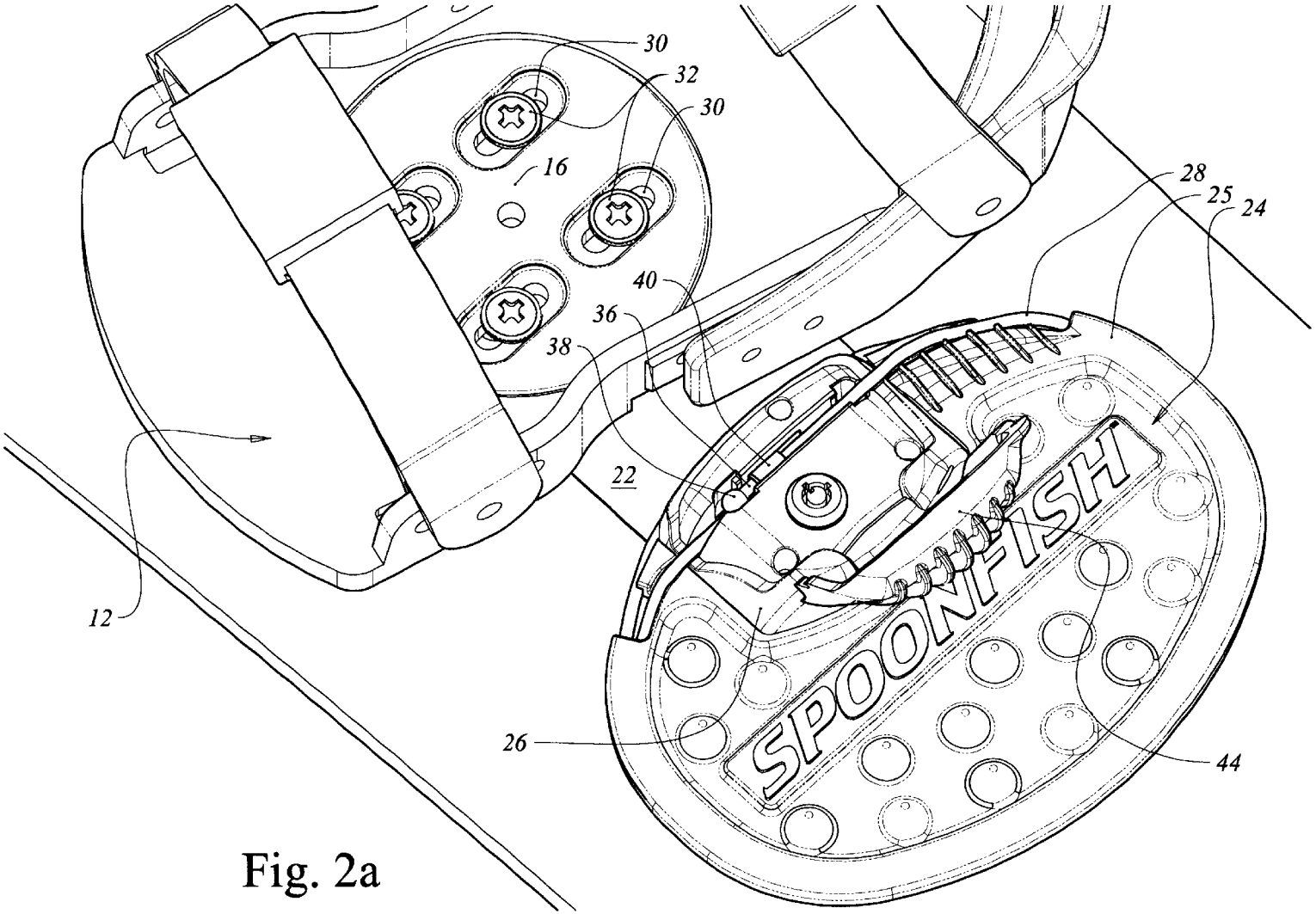
FIGS. 2*a* through 2*e* illustrate the locking device of FIG. 1 in further detail.
Figure 2B:
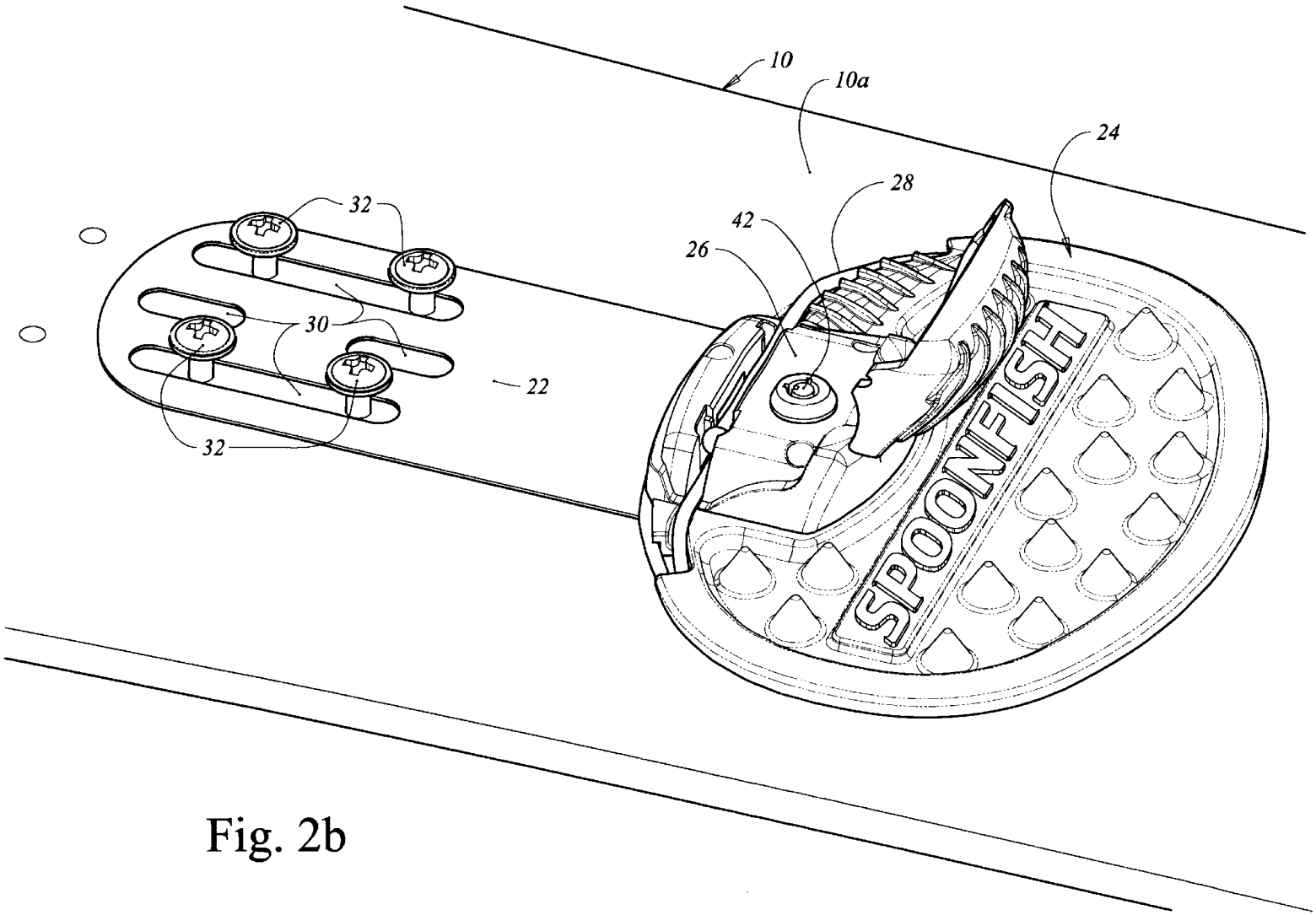
Figure 2C:
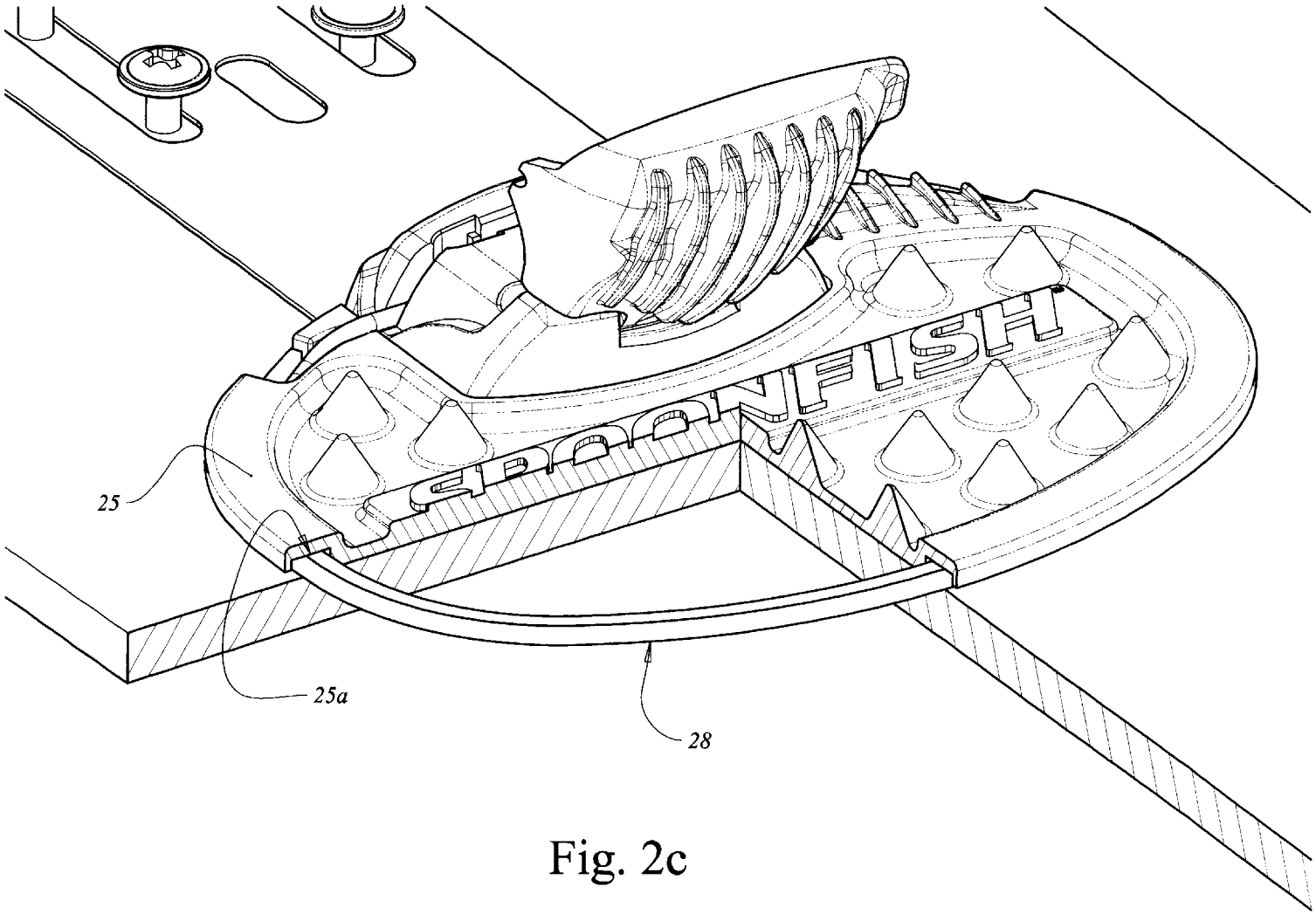

The other end 36 has an enlarged tip 38 and is attached to the locking device 26 and disposed underneath a locking pin 40 when in the locked condition. The locking device 26 preferably is a key lock having a tumbler 42 (FIG. 2*b*) in which a key (not shown) can be inserted to cause the locking pin 40 to retract to thereby release the free end 36 of the cable 28. The cable 28 normally is disposed underneath an outer flange 25 of the pad 24, and the flange 25 is flexible and includes a cavity 25*a* underneath which the cable 28 can be wrapped as seen in FIGS. 2*a*–2*c*. The cable 28 thus is essentially self-storing on the board and is out of the way of the snowboarder, and also does not have to be carried in a pocket.

When the lock 26 is opened thereby retracting the pin 40, the cable can be unwrapped from underneath the pad 24 flange 25 and placed around a fixed object such as a pole or the like, and then the free end 36 is returned to the lock underneath the pin 40 and the lock again locked so as to advance the pin 40 to secure the free end 36 in the lock 26. In this manner, a snowboard 10 can be locked to a fixed object to prevent or deter theft while the snowboarder is having lunch, resting, or engaging in other activities or the like. The lock 26 preferably also includes a flexible cover 44 over the tumbler 42. The lock preferably is formed of an impact resistant tough material which can withstand the cold temperatures involved in snowboarding, and can be a nylon or polycarbonate alloy. An example lock is a Model No. 10287 tubular lock or No. 12009 manufactured by Windcorp.

It is important that the plate 22 be as thin as possible, while being sufficiently strong to secure the lock 26 and cable end, so as not to raise the boot binding 12 by any significant amount. It is preferred not to raise the bindings 12 more than about $1/16^{th}$ inch; however; $1/4^{th}$ to $3/8^{th}$ inch may be acceptable which is sufficiently high to accommodate the cable 28, and it may be possible to go as high as ½ inch. Also, it is important to use the existing holes (to which the mounting bolts 32 attach—FIG. 2*b*) rather than drilling or otherwise providing additional holes in view of the typical structure of such boards 10 which frequently are of a honeycomb structure and have threaded inserts for the bolts 32. A key type lock 26 may be preferable because generally they are smaller than combination locks (although combination lock embodiments are discussed later). The types of key locks using a small cylindrical key appear to be more durable, harder to tamper with, and appear to be less of a problem around snow and ice.

Figure 2D:
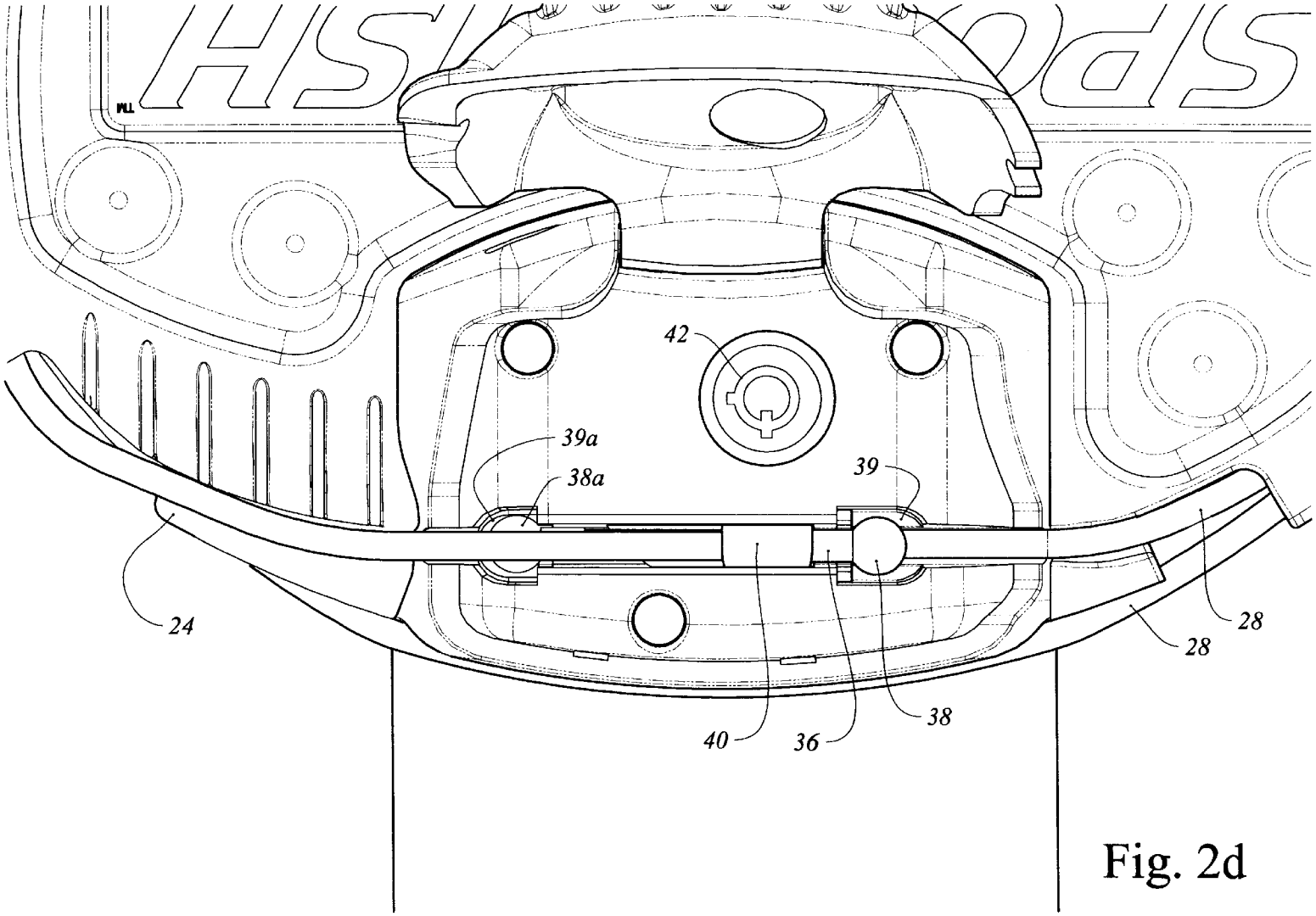
Figure 2E:
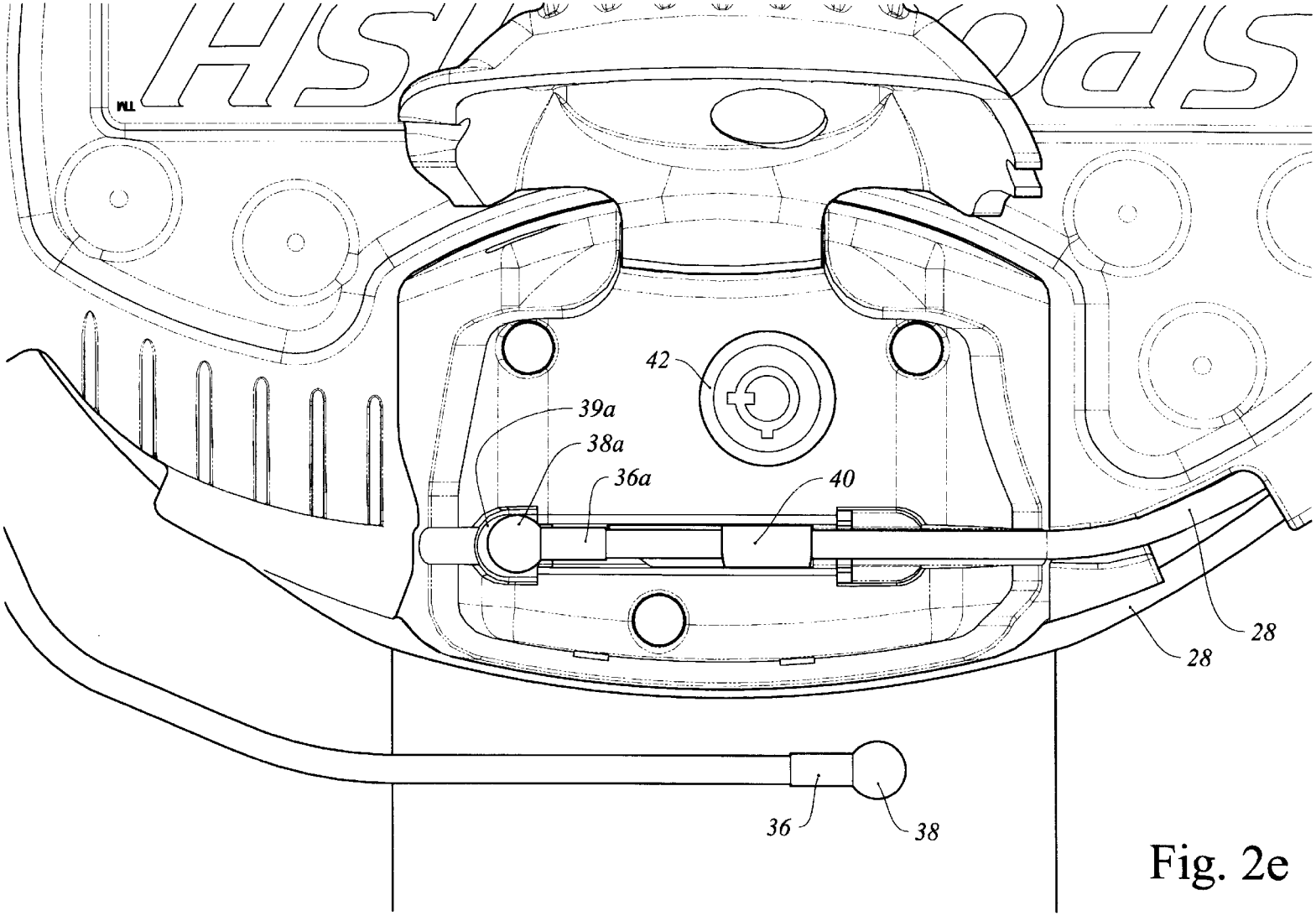

FIGS. 2*e* and 2*d* illustrate further details of attachment of the ends 38 and 38*a* of the cable 28. FIG. 2*d* shows both ends fully captured in the lock via the locking pin 40. FIG. 2*e* shows the end 36 of the cable 28 after it has been released from the lock, as for example before attaching a cable around a fixed stationery object. The locking pin 40 can be retracted (by turning the key lock) to fully release the cable 28 by releasing the end 36*a* and enlarged ball tip 38 entirely from the locking device 26. In the embodiment shown, rotation of the lock rotates the locking pin 40 to cover and uncover the ends of the cable 28. This can be useful where the user wants to completely remove the cable. It will be noted that the enlarged end 38*a* is captured in a recess 39*a*, and when the loose end 36 is relocked (noted FIG. 2*d*) the enlarged end 38 fits within a recess 39. This arrangement provides also for a relatively compact assembly.

Figure 3A:
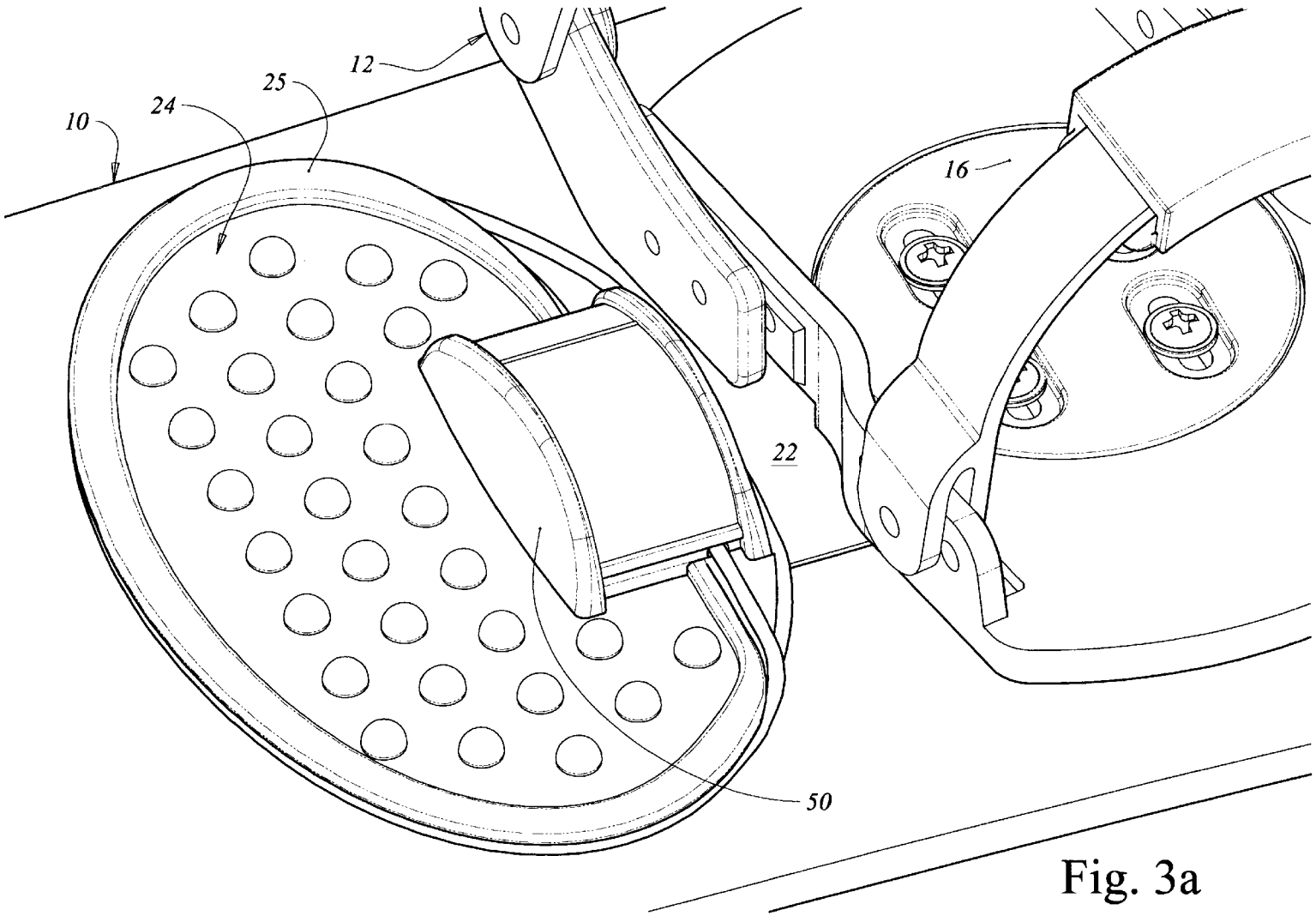
FIGS. 3*a* and 3*b* are perspective views of another embodiment of a snowboard locking device.
Figure 3B:
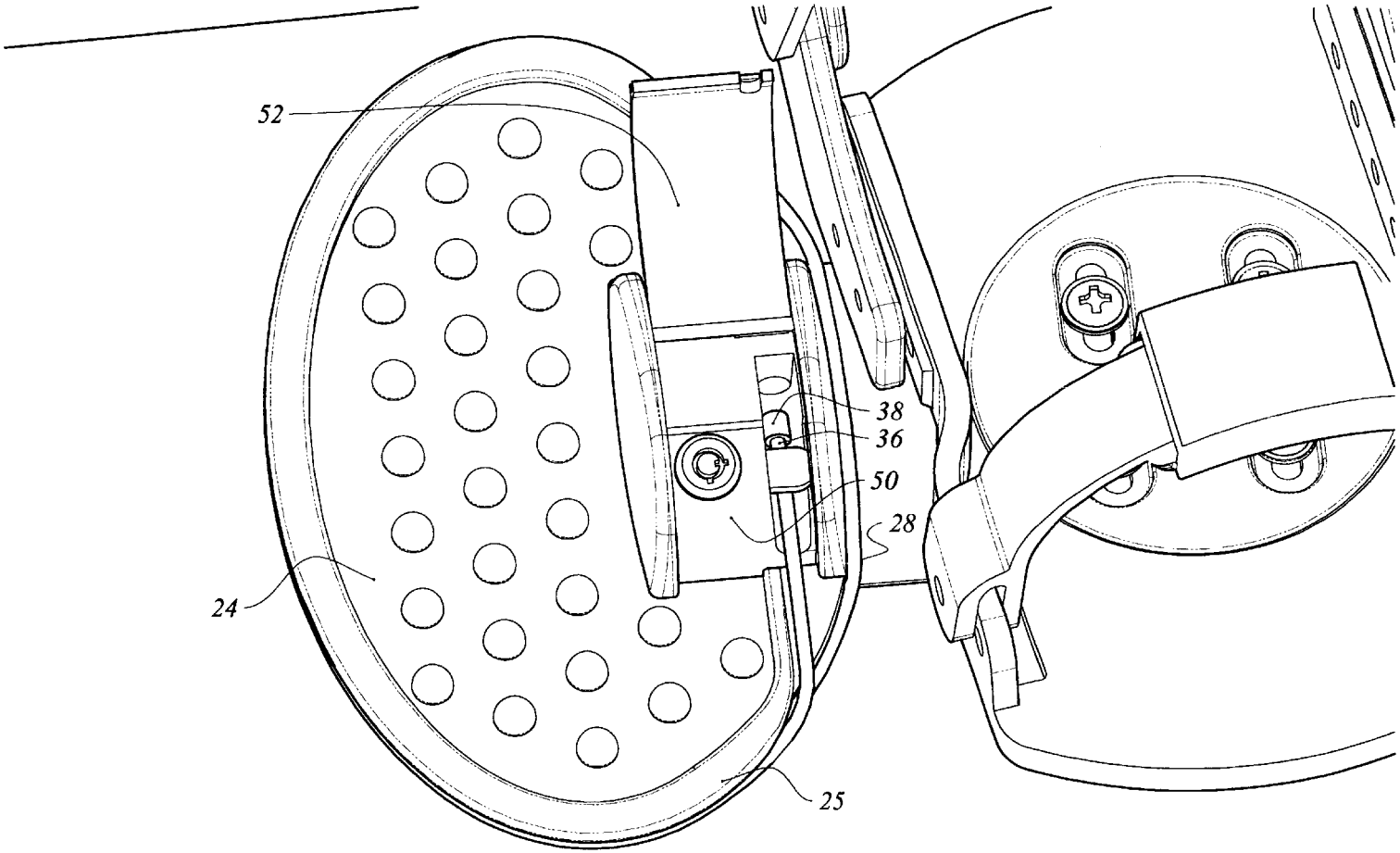

FIGS. 3*a* and 3*b* illustrate an alternative lock 50 having a hinged cover 52. The remaining components are of the same type shown in FIGS. 1 and 2 and have like reference numbers.

Figure 4A:
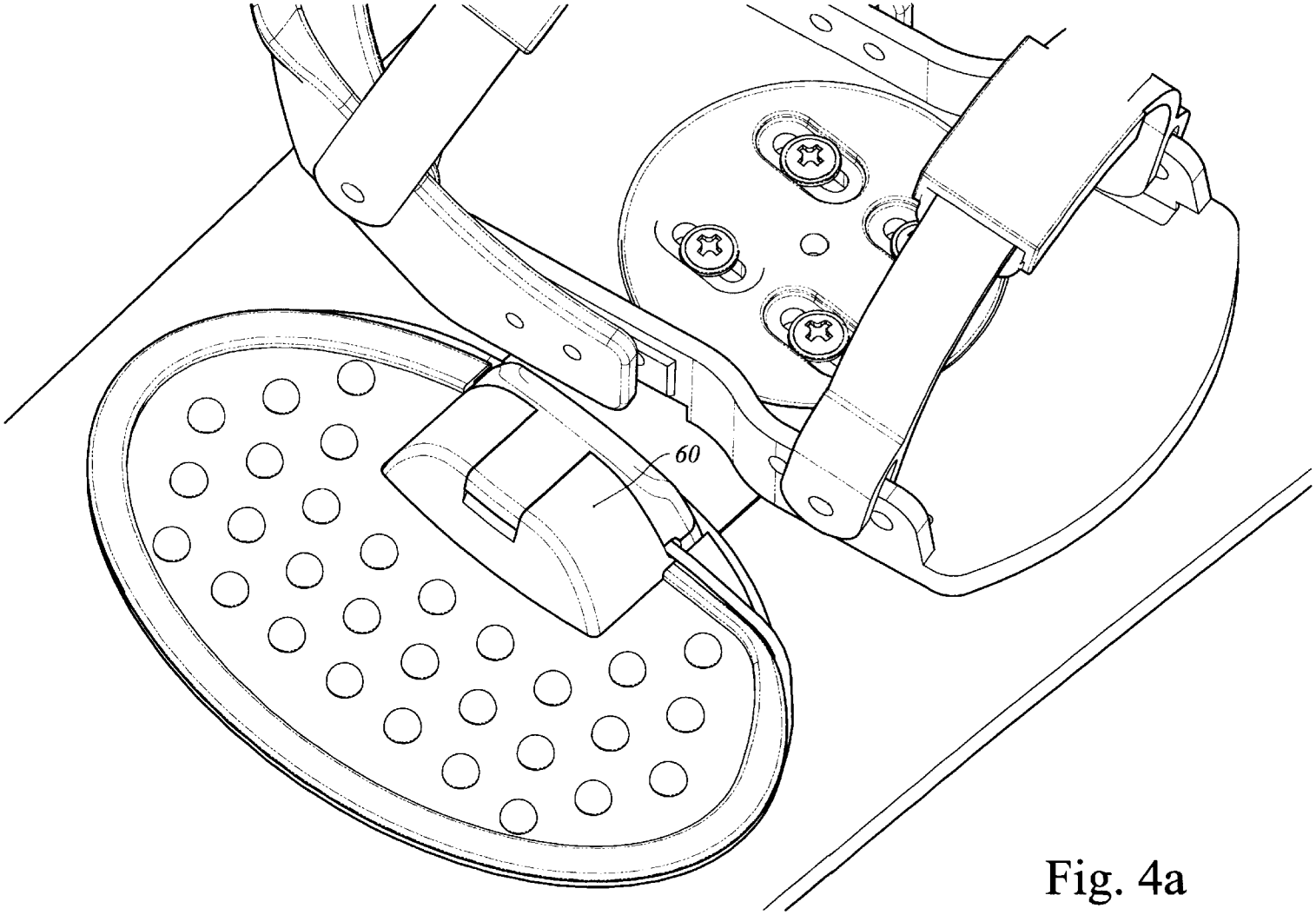
FIGS. 4*a* and 4*b* illustrate another embodiment.
Figure 4B:
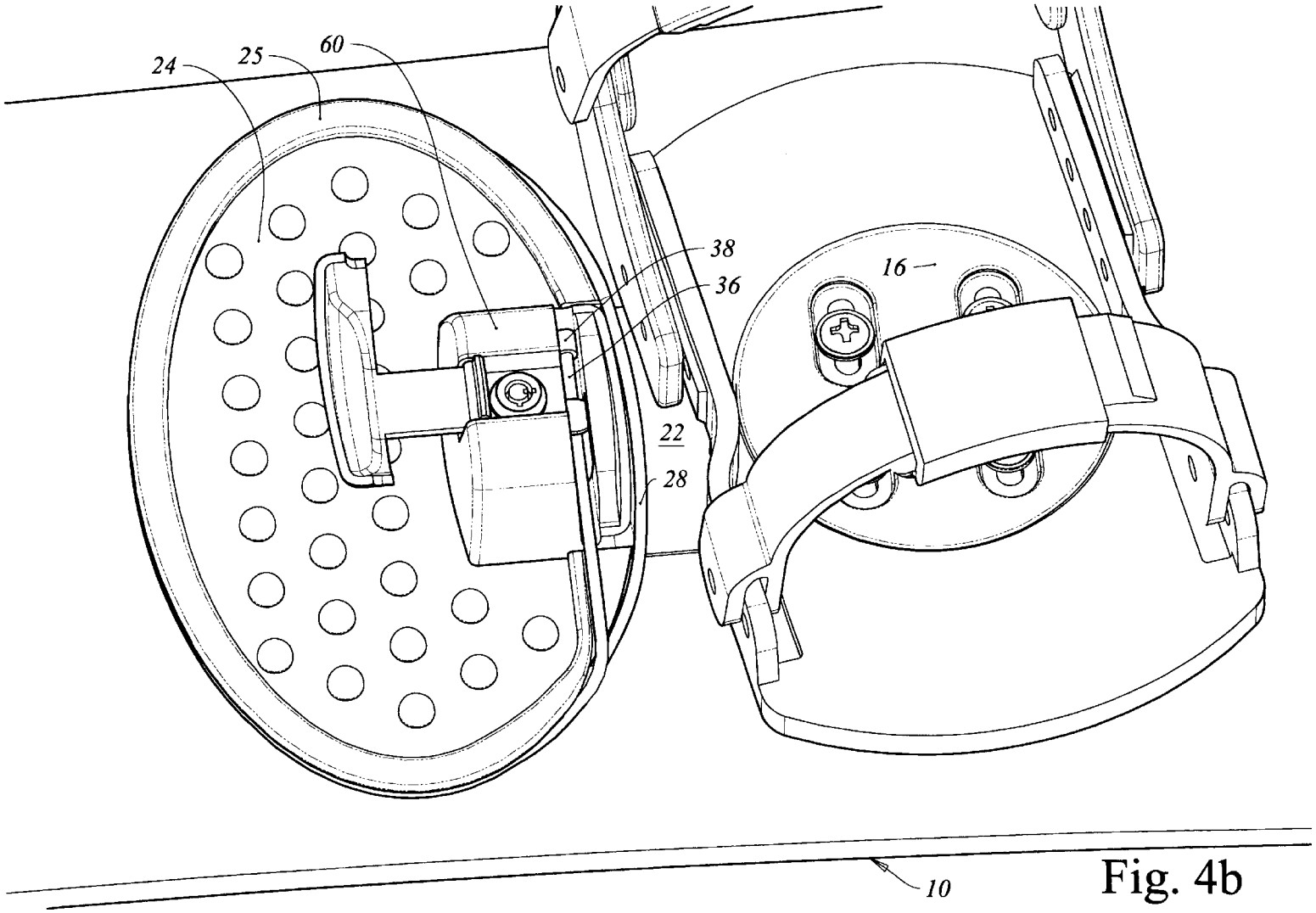

FIGS. 4*a* and 4*b* illustrates another embodiment using a different form of lock 60 having a hinged cover 62.

Figure 5A:
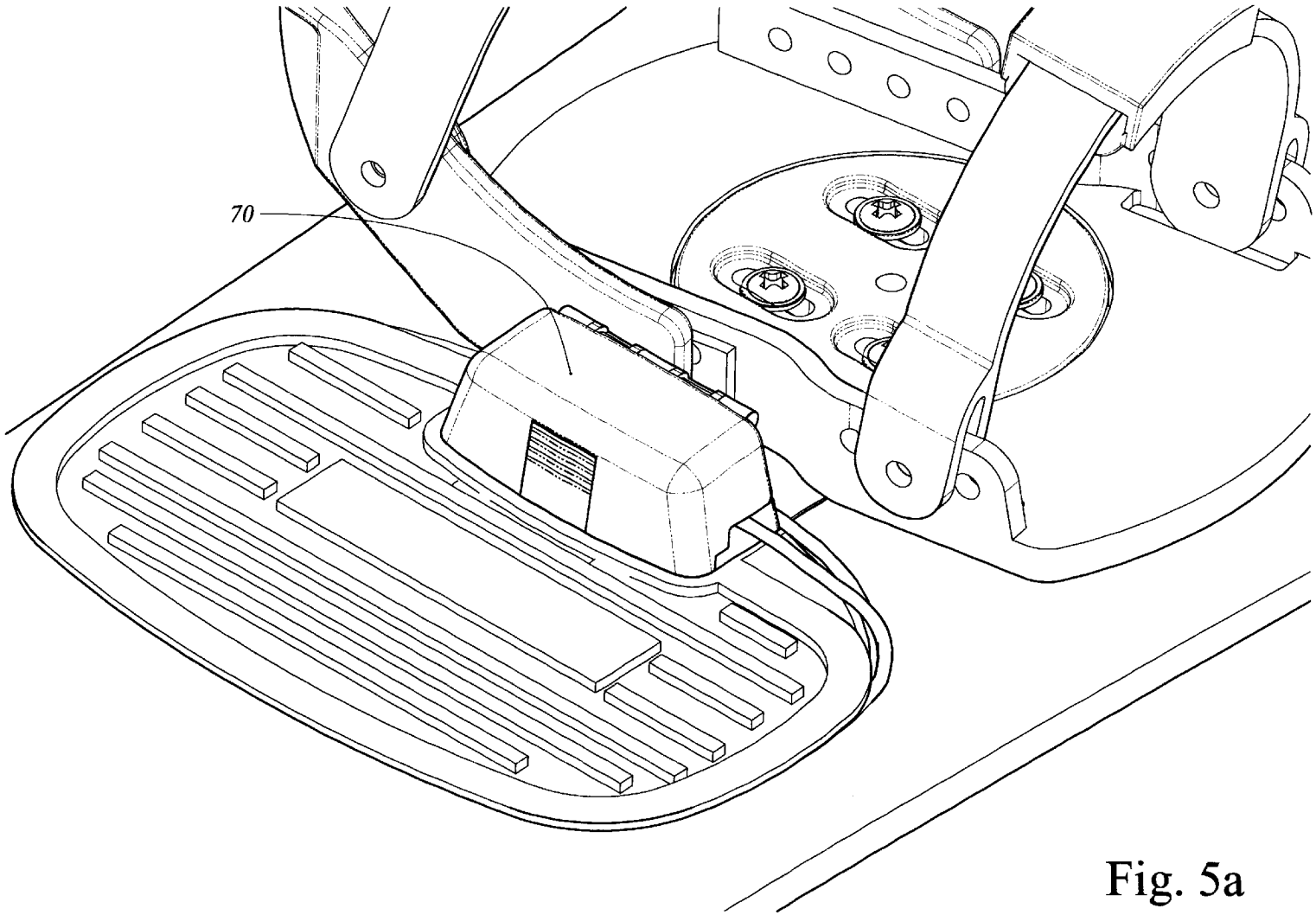
FIGS. 5*a* and 5*b* illustrate another embodiment using a combination lock.
Figure 5B:
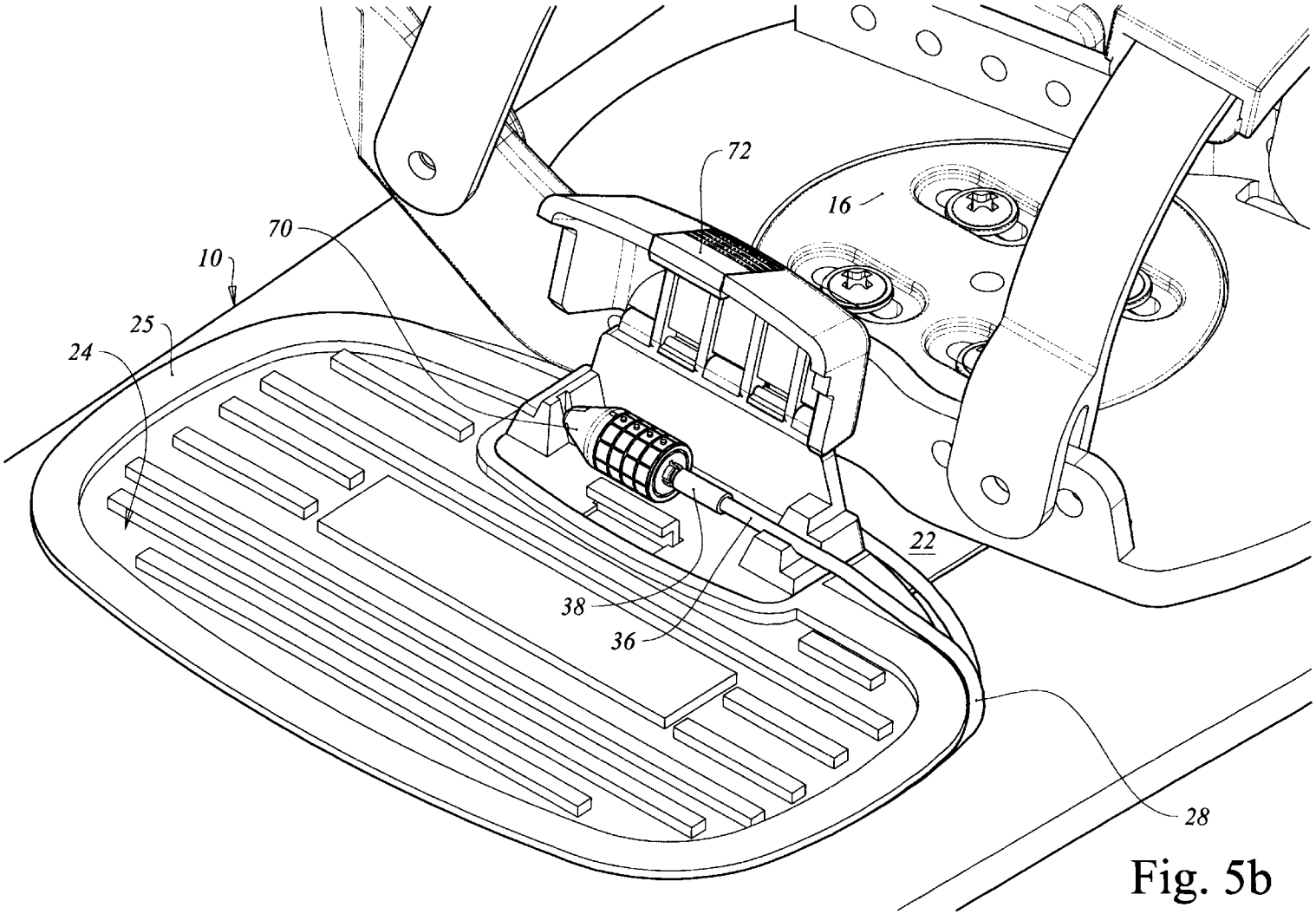

FIGS. 5*a* and 5*b* illustrate a further embodiment, but in this case the lock comprises a combination lock 70. The tip end 38 of the cable 28 is captured axially in the lock 70.

Figure 6A:
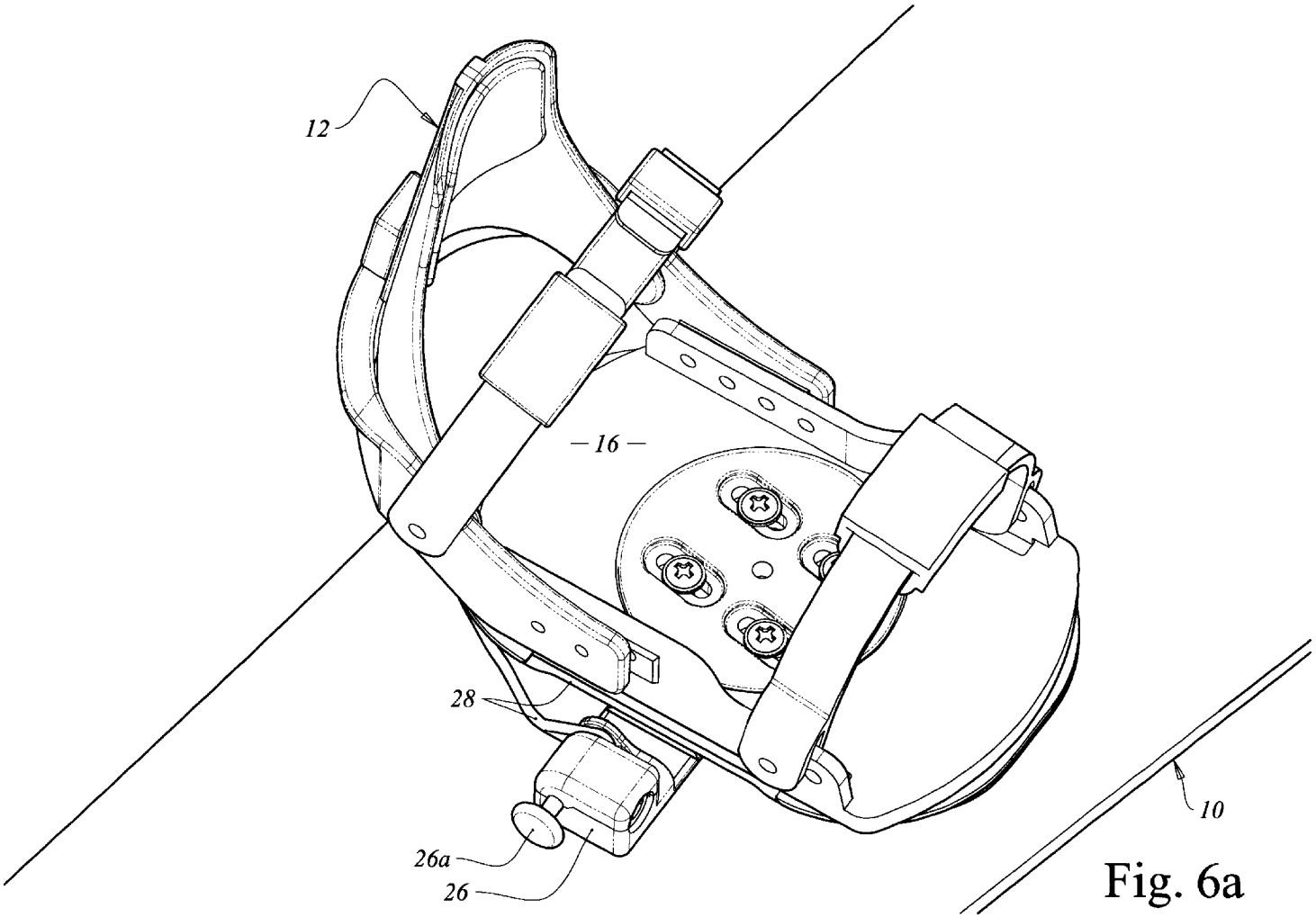
Figure 6B:
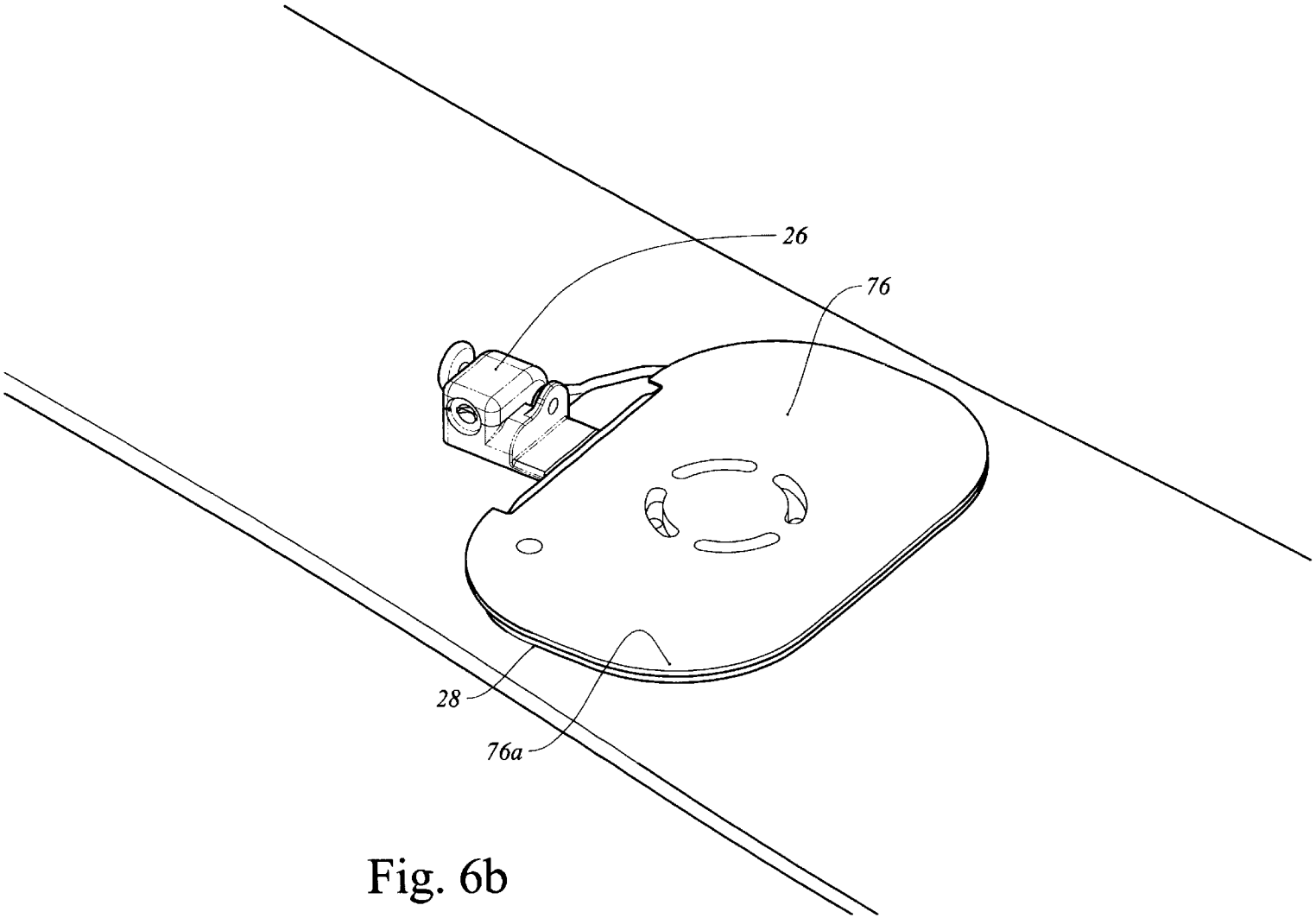
Figure 6C:
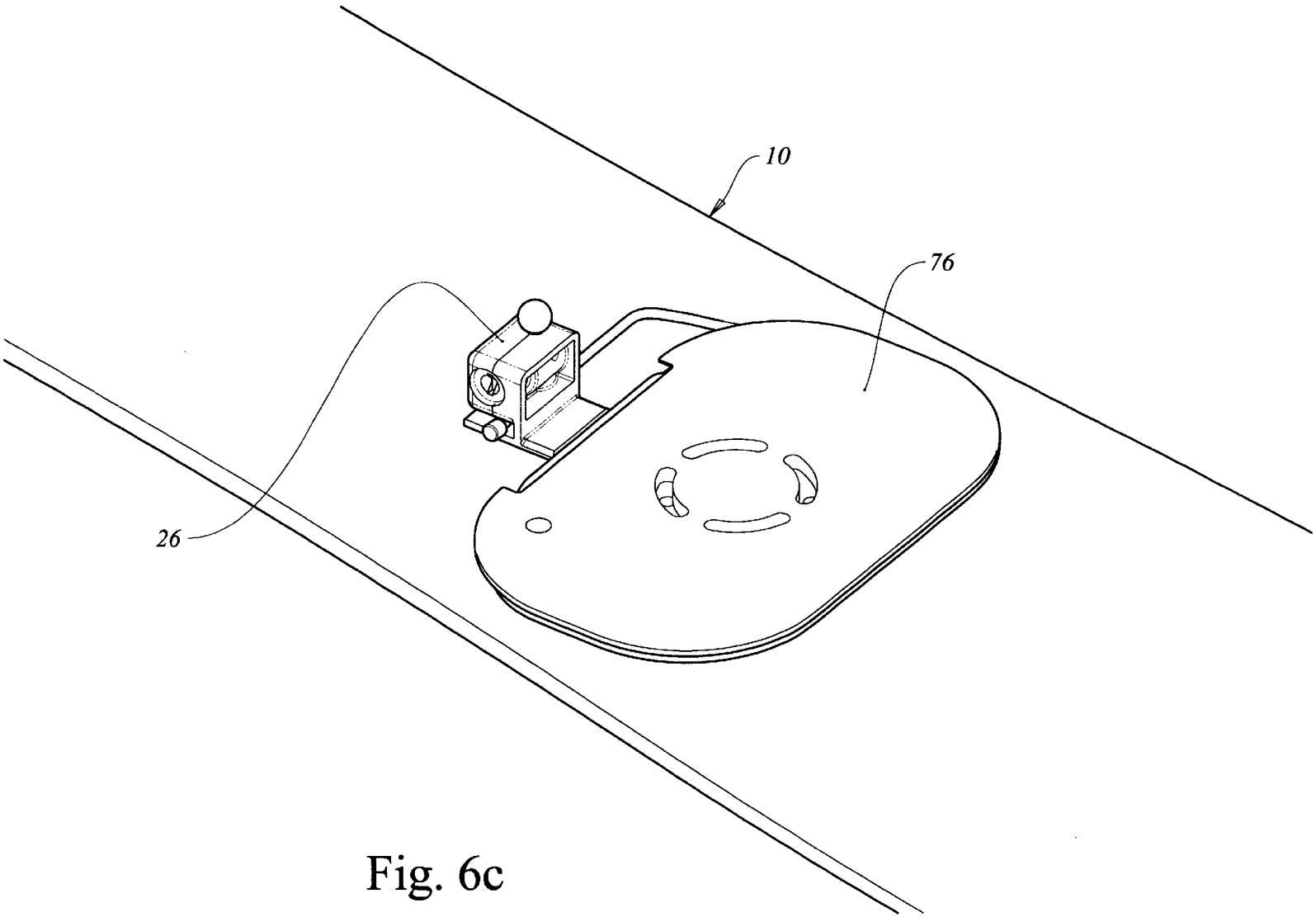
Figure 6D:
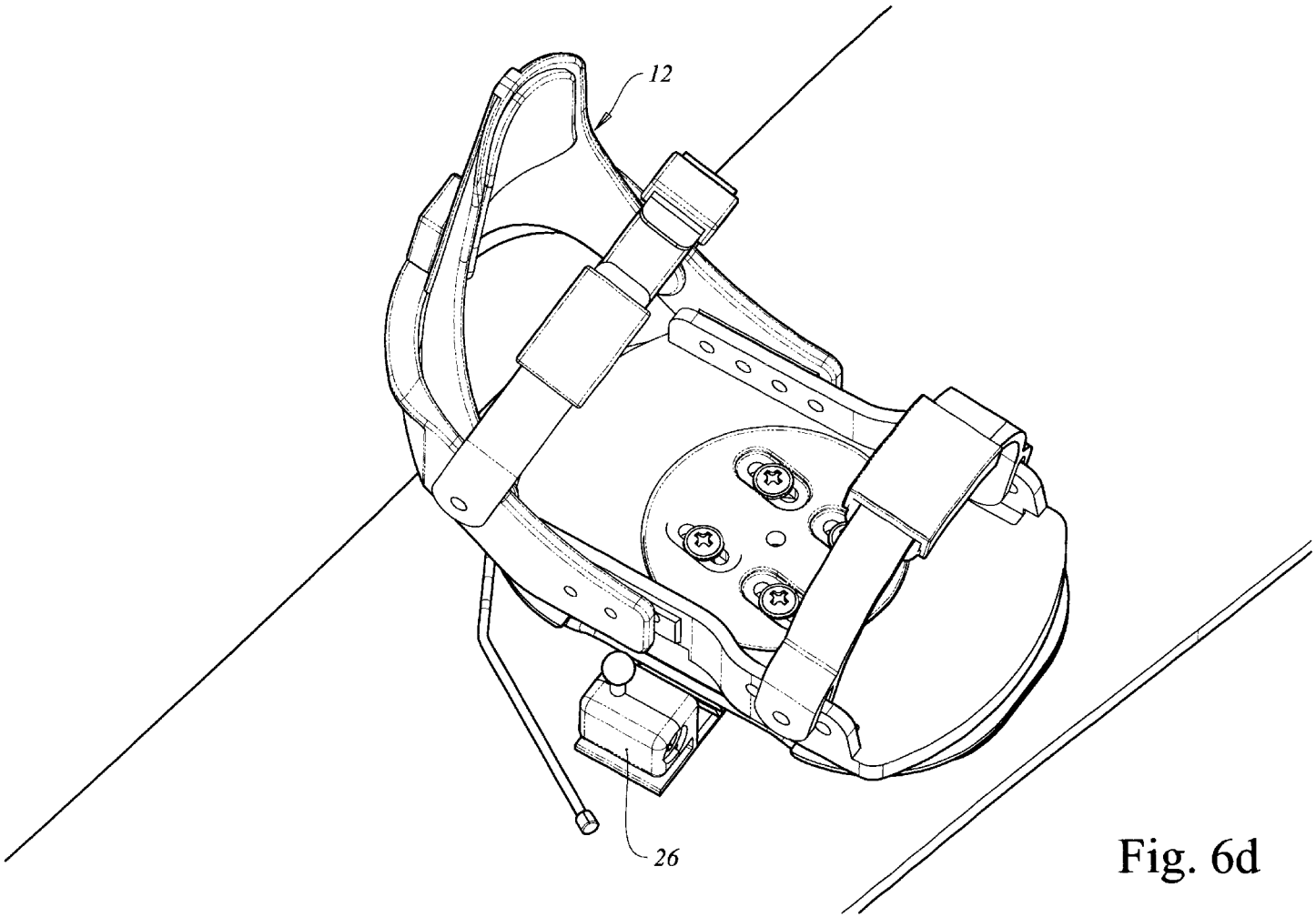
Figure 6E:
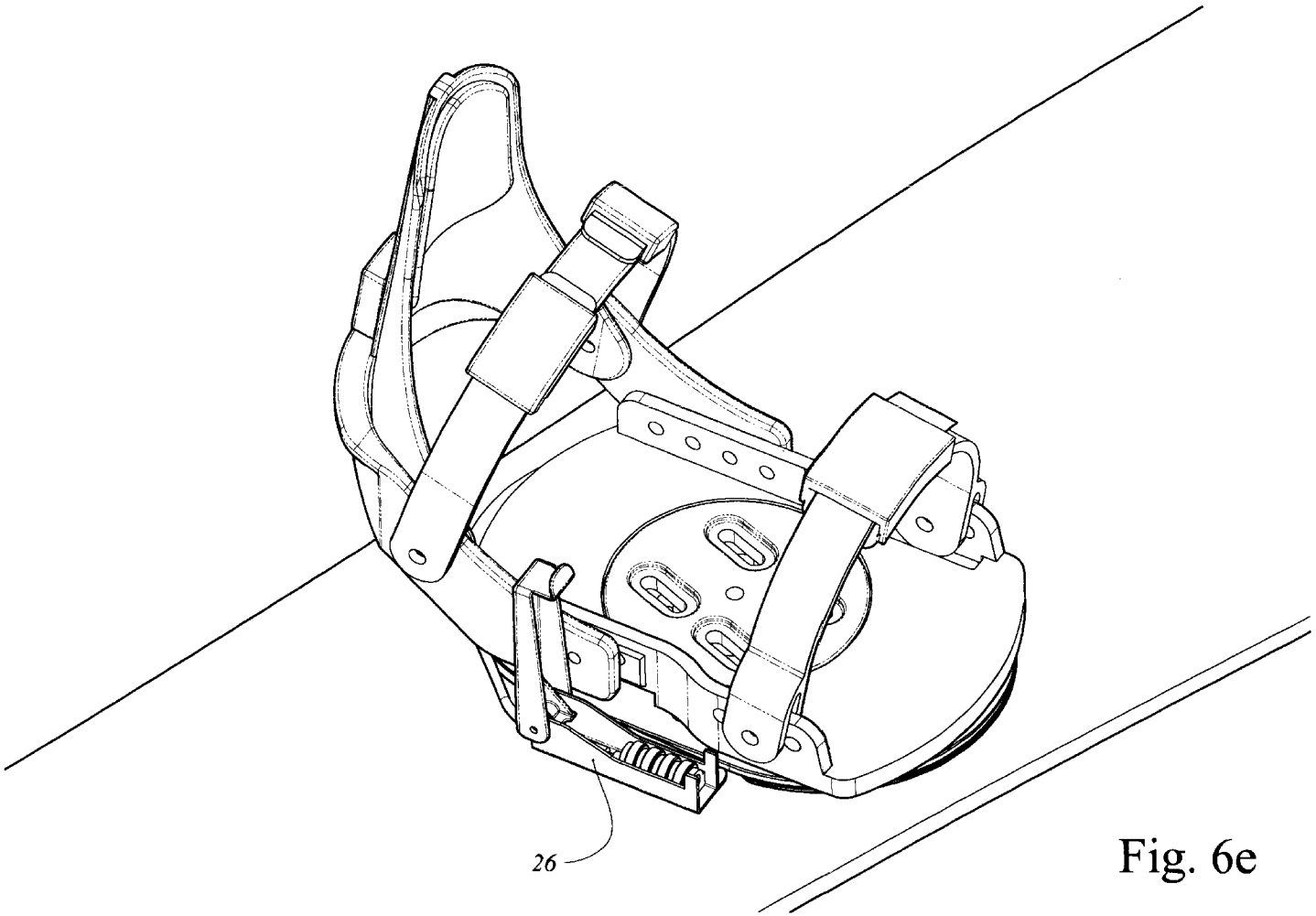
Figure 6F:
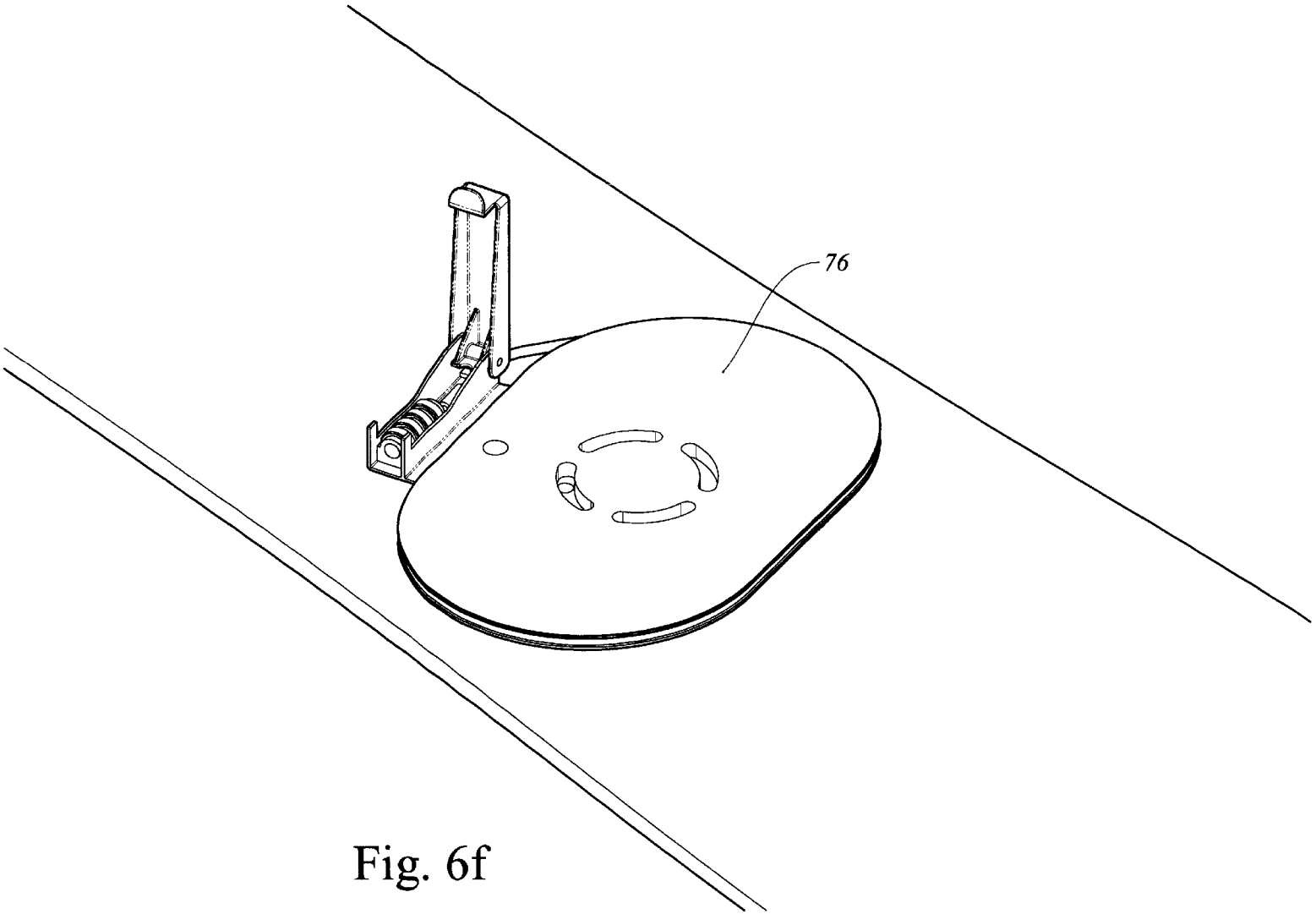
Figure 7A:
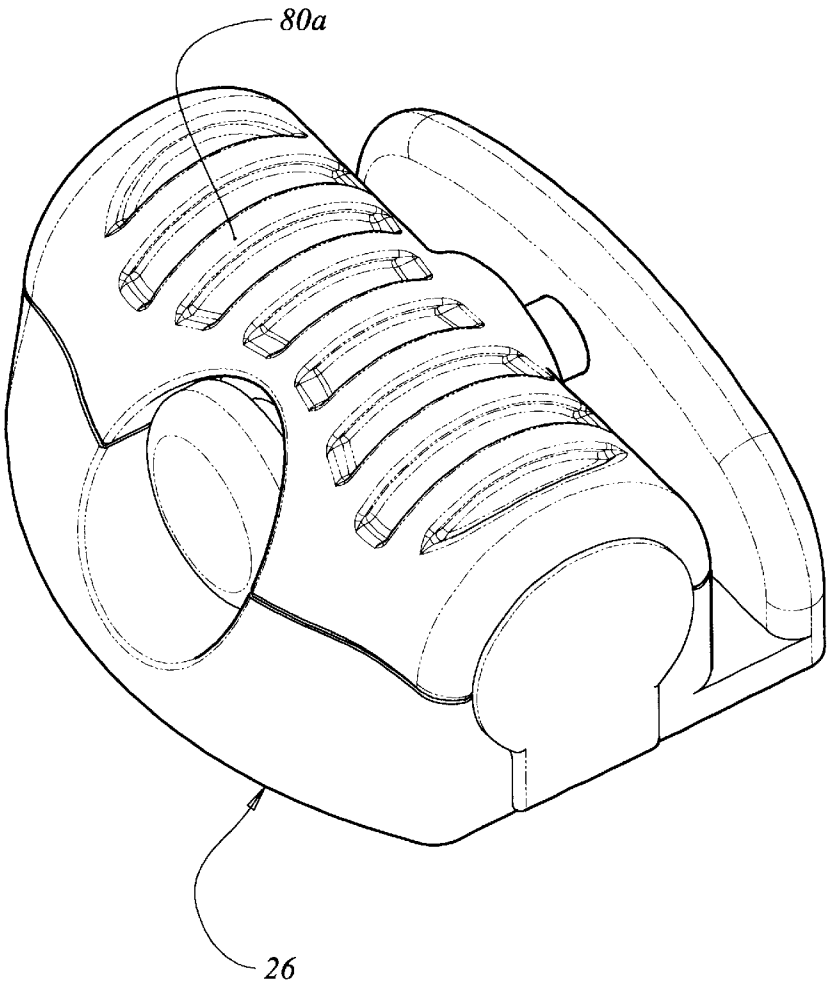
FIGS. 7*a* through 7*d* show forms of locks with different surfaces to provide "stomp pads.
Figure 7B:
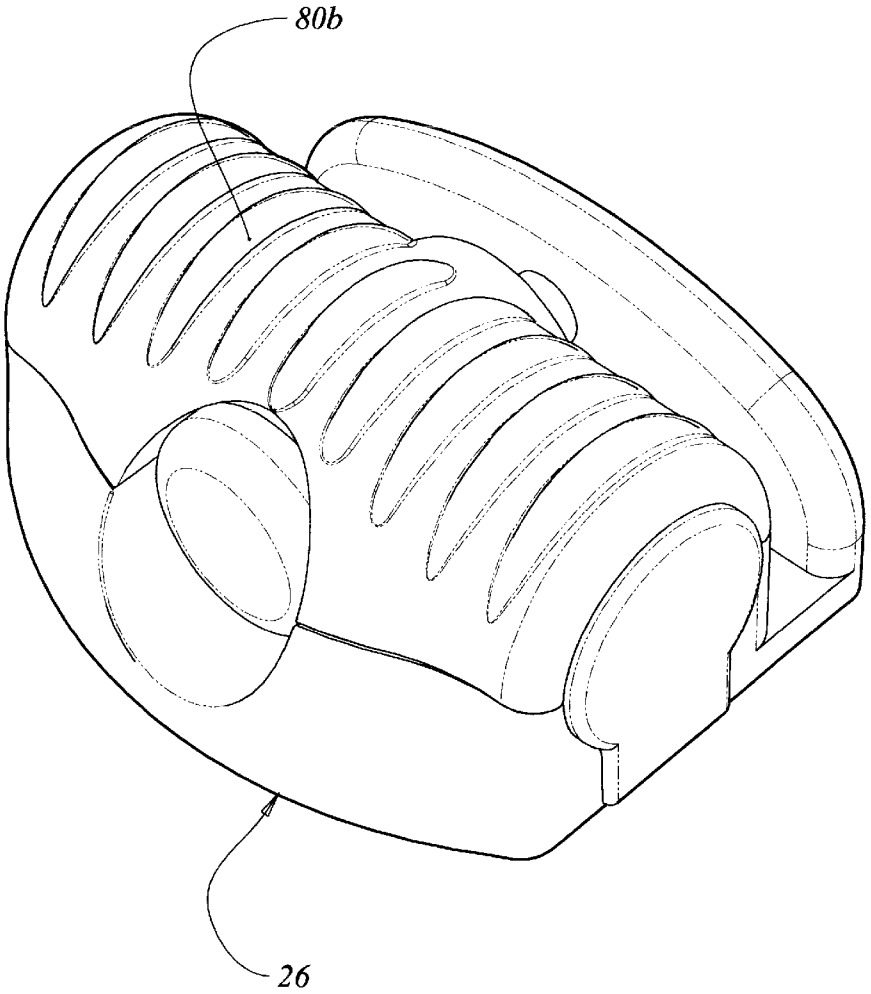
Figure 7C:
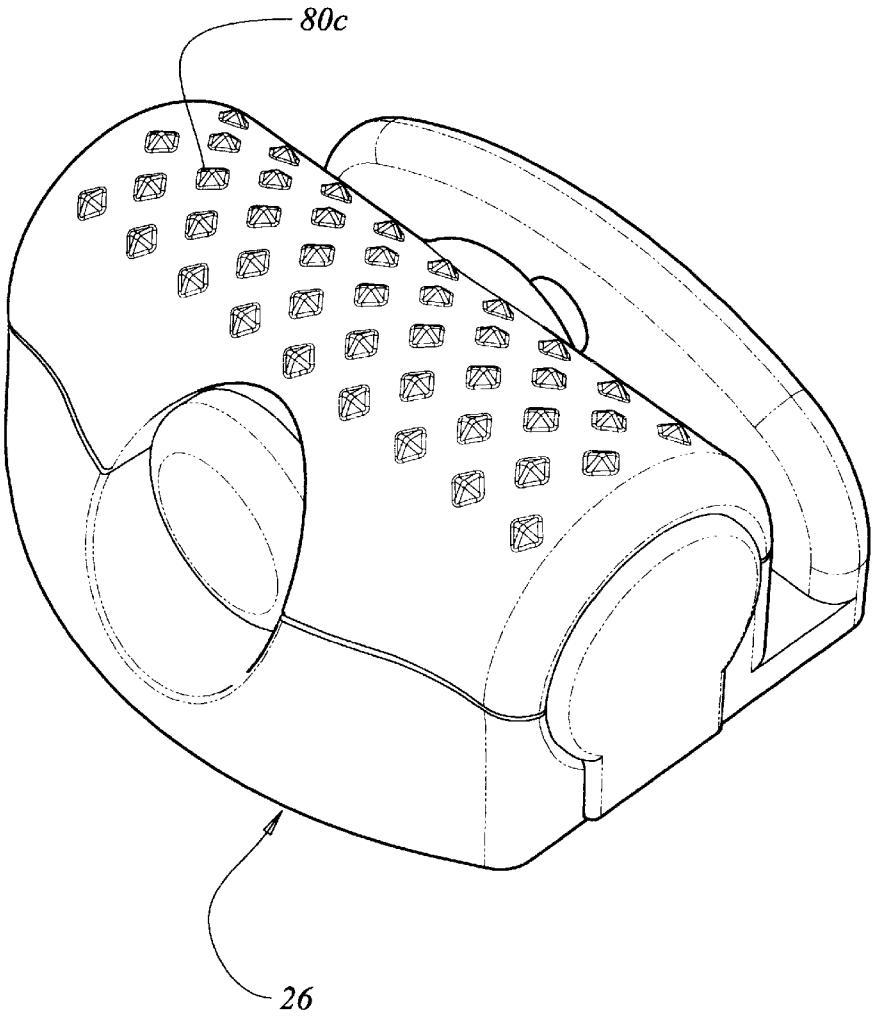
Figure 7D:
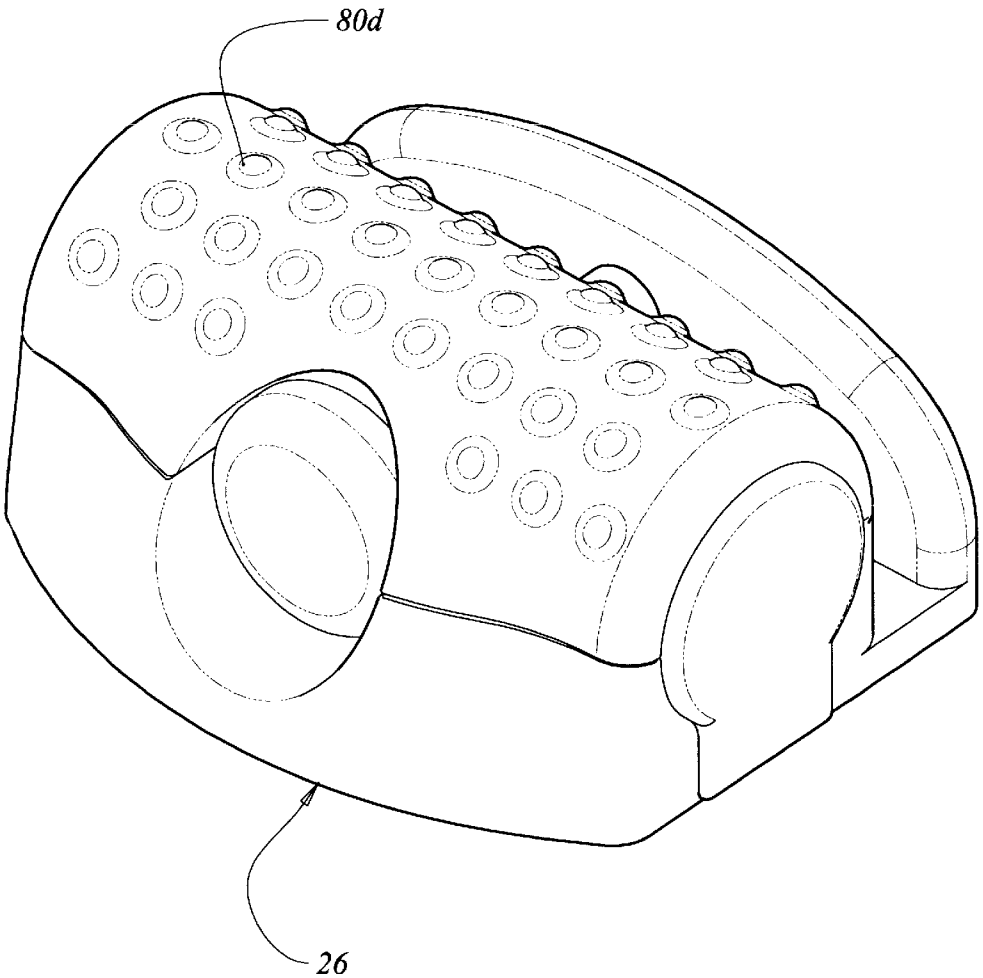
Figure 8A:
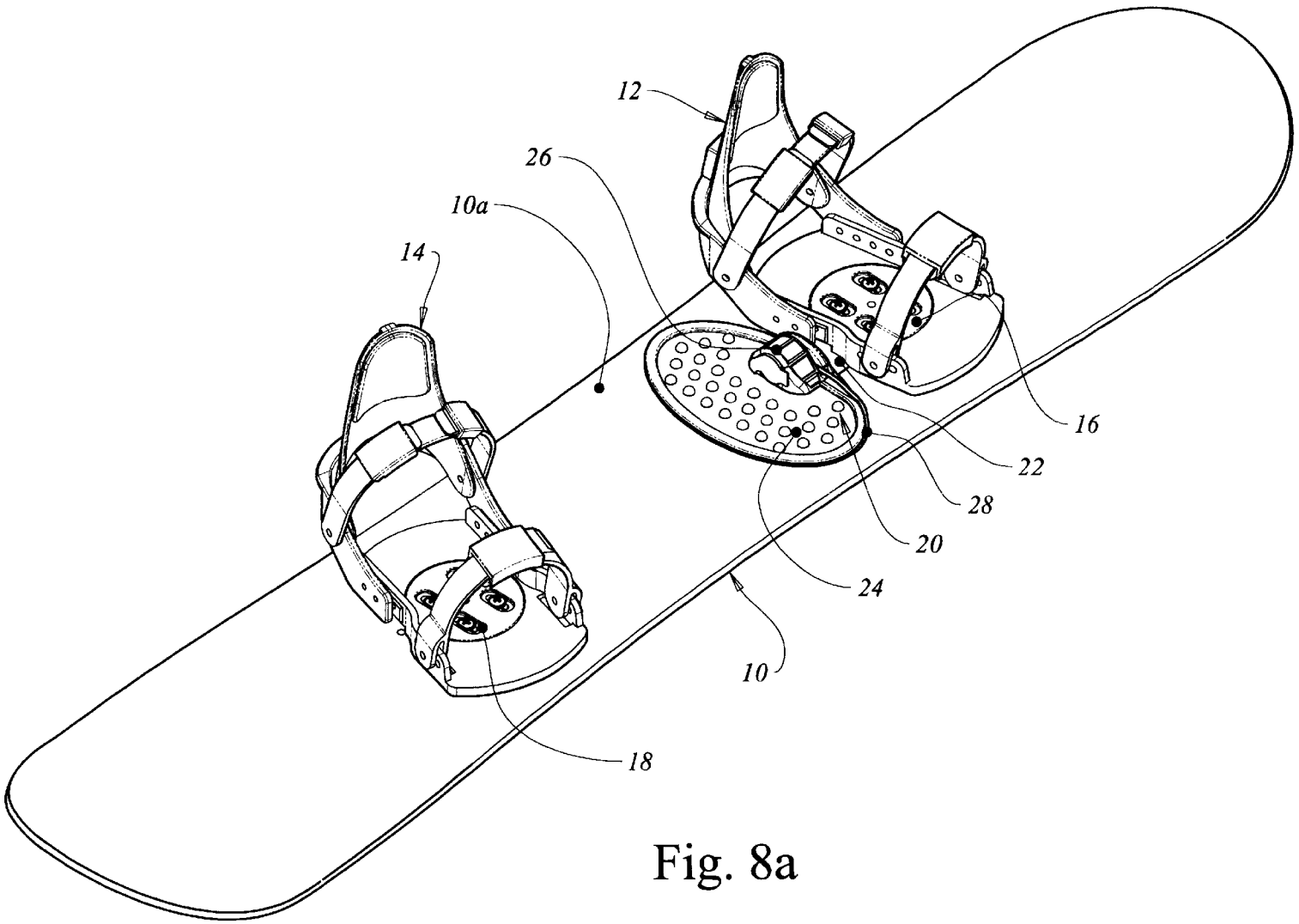
Figure 8B:
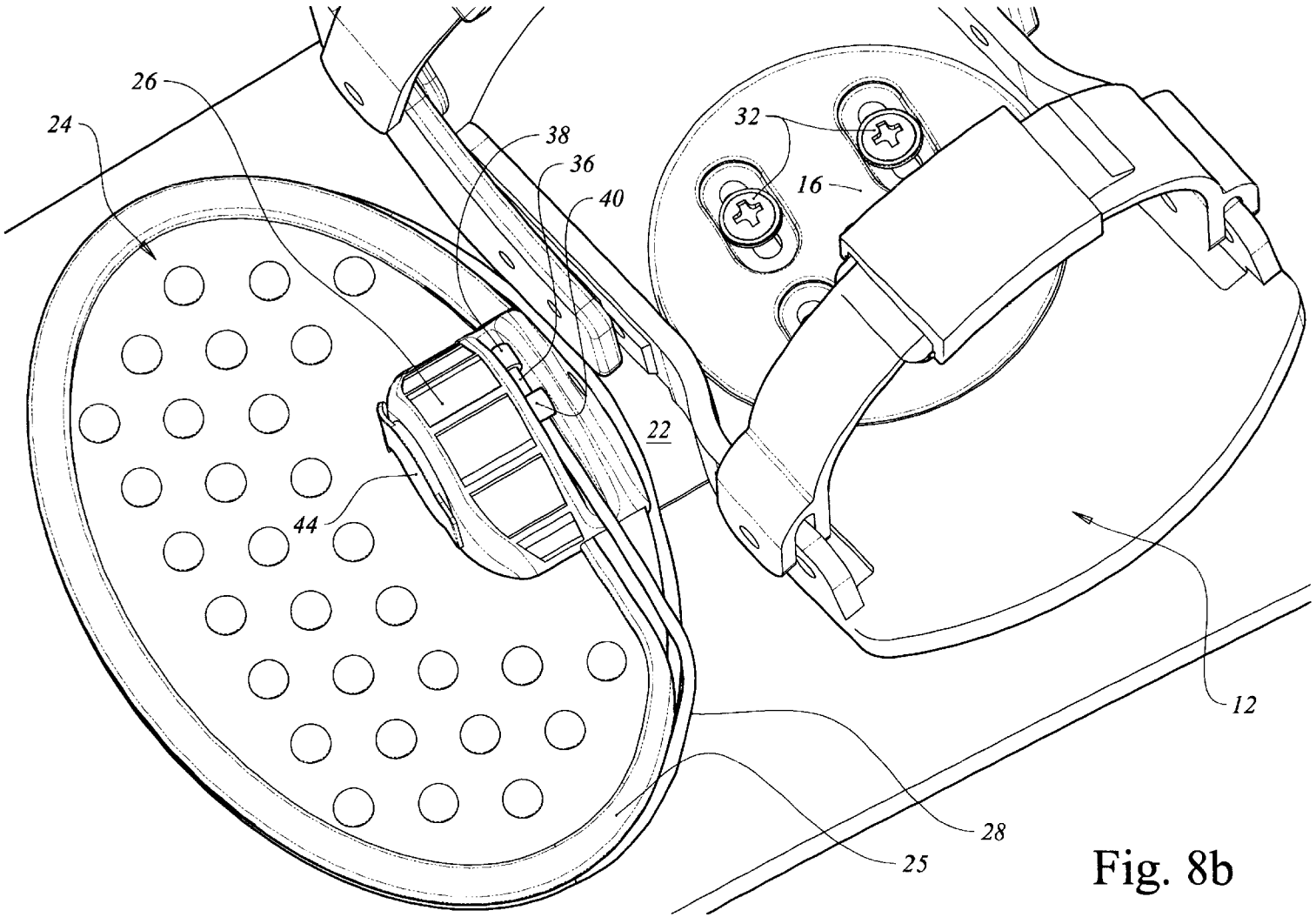

FIGS. 6*a* through 6*f* show alternative forms of snowboard security locks. In these embodiments, the cable 28 is disposed around a plate 76 (see FIGS. 6*b*, 6*c* and 6*f*). Like or similar parts have the same reference numbers used on the earlier Figures. A lock assembly 26 is provided and is affixed to the mounting plate 76. One end of the cable 28 is affixed to the plate 76 such as disposed between the plate and lock body, and the other end is held by a pin 26*a* of the lock 26 and can be released when the lock is unlocked. The fixed end of the cable also can be disposed in a recess in the binding 12 to trap this end. FIGS. 6*a* and 6*b* show one embodiment of a key lock 26, FIGS. 6*c* and 6*d* show another embodiment of a key lock 26, and FIGS. 6*e* and 6*f* show a form of combination lock 26. The plate 76 either has an angular groove 76*a*, or is spaced above the board 10 to form the groove, around the outer edge about which the cable 28 can be wrapped when the snowboard is not in use, and from which the cable 28 can be unwound so that the cable can be released from the lock, wrapped around a fixed object such as a post of the like, and relocked to secure the snowboard to the fixed object.

FIGS. 7*a* through 7*d* illustrate forms of locks 26 that can be used on any of the previous embodiments, but each has a configured upper surface 80*a* through 80*d*. The configured surface 80*a*–80*d* are ribbed or bumpy so as to function as a stomp pad for the snowboarder. Any of these textured surfaces can be provided on any of the locks 26 whether or not the textured pad 24 is provided. Preferably, the textured surface 80 can be of a resilient material, but it can be formed from other materials. Any of these locks is particularly useful as the lock of the security locking devices and also to provide a stomp pad. A separate pad, similar to pad 24 also can be used if desired.

While embodiments of the present invention have been shown and described, various modifications may be made without departing from the scope of the present invention, and all such modifications and equivalents are intended to be covered.

What is claimed is:

1. A locking apparatus for sporting equipment such as a snowboard and the like having a support member for a boot or shoe, and comprising a plate adapted to be affixed to mounting points of the equipment used for the support member, and a lock device including a lock and a cable, the lock device being affixed to the plate, there being a restraining area around the lock about which the cable can be wrapped for storage of the cable on the equipment when the equipment is in use, the cable being releasable from the lock and restraining area to allow the cable to be wrapped about a fixed object and secured back to the lock to thereby attach the sporting equipment to the fixed object to prevent or minimize theft of the sporting equipment.

2. A locking apparatus as in claim 1 wherein the sporting equipment is a snowboard having an upper surface, the plate is mounted to the upper surface of the snowboard underneath the support member with fasteners used for fastening the support member to the snowboard.

3. A locking apparatus as in claim 2 wherein the support member is a boot binding.

4. A locking apparatus as in claim 3 wherein the plate has an outwardly extending portion, and the pad is affixed adjacent the locking device to the outwardly extending portion of the plate, the pad having an outer flange providing a cavity housing the restraining area within which the cable can be wrapped and stored while the snowboard is in use.

5. A locking apparatus as in claim 2 wherein the support member is a boot binding, the plate extends outwardly from underneath the boot binding along the surface of the snowboard, and the lock device is affixed to the plate, and the plate extends beyond the lock device and is captured by the pad affixed to the plate and to the board.

6. A locking apparatus as in claim 5 wherein the pad has an outer flange providing a cavity forming the restraining area within which the cable can be wrapped and stored while the snowboard is in use.

7. A locking apparatus for a snowboard and the like having mounting points and a binding for a boot or shoe, and comprising a plate adapted to be affixed to the mounting points of the snowboard used for attaching a binding, a lock device including a lock and a cable, the lock device being affixed to the plate, there being a restraining area in the form of a pad about which the cable can be wrapped for storage of the cable on the snowboard when the snowboard is in use, the cable being releasable from the lock device and restraining area to allow the cable to be wrapped around a fixed object and secured back to the lock to thereby attach the snowboard to the fixed object to prevent or minimize theft of the snowboard, the pad being affixed to the plate, and the pad having a flexible outer flange forming the restraining area for the cable, and the lock device includes a recess for normally capturing an enlarged end of the cable and so as to allow the cable to be released from the lock device and snowboard.

8. A locking apparatus as in claim 7 wherein the pad includes a space between a surface of the snowboard and the pad thereby forming essentially an annular chamber within which the cable can be wrapped while the snowboard is in use.

9. A locking apparatus as in claim 8 wherein the plate extends outwardly from underneath the binding along the surface of the snowboard, and the lock device is affixed to the outwardly extending portion of the plate.

10. A locking apparatus 8 wherein the plate extends outwardly from underneath the boot binding along the surface of the snowboard, and the lock device is affixed to the plate, and the plate extends beyond the lock device and is captured by the pad affixed to the plate and to the board.

11. A locking apparatus as in claim 7 wherein the lock device has an upper surface forming a stomp pad.

12. A locking apparatus for a snowboard and the like having mounting points and a binding for a boot or shoe, and comprising a plate adapted to be affixed to the mounting points of the snowboard used to attach the binding, a lock device including a lock and a cable, the lock device being affixed to the plate, there being a restraining area around the binding about which the cable can be wrapped for storage of the cable on the snowboard when the snowboard is in use, the cable being releasable from the lock device and restraining area to allow the cable to be wrapped around a fixed object and secured back to the lock to thereby attach the snowboard to the fixed object to prevent or minimize theft of the snowboard.

13. A locking apparatus as in claim 12 wherein the lock device has a surface comprising a stomp pad.

14. A locking apparatus as in claim 12 wherein the restraining area includes a space between a surface of the snowboard and the binding thereby forming essentially an annular chamber within which the cable can be wrapped while the snowboard is in use.

15. A locking apparatus as in claim 12 wherein the lock device includes a member for normally capturing an end of the cable and so as to allow the cable to be released from the lock device.

16. A locking apparatus as in claim 12 wherein the plate is spaced from the snowboard surface to form an annular area for receiving the cable, and the lock device is affixed to a portion of the plate.

17. A locking apparatus as in claim 16 wherein the lock device has an upper surface forming a stomp pad.

18. A locking apparatus for sporting equipment such as a snowboard and the like having a support member for a boot or shoe, and comprising a plate adapted to be affixed to mounting points of the equipment used for the support member, a lock device including a lock and a cable, the lock device being affixed to the plate, there being a restraining area about which the cable can be wrapped for storage of the cable on the equipment when the equipment is in use, the cable being releasable from the lock device and restraining area to allow the cable to be wrapped about a fixed object and secured back to the lock to thereby attach the sporting equipment to the fixed object to prevent or minimize theft of the sporting equipment, and a pad affixed to the plate, and the pad having a flexible outer flange forming the restraining area for the cable.

19. A locking apparatus as in claim 18 wherein the pad comprises a stomp pad.

20. A locking apparatus for sporting equipment such as a snowboard and the like having a support member for a boot or shoe, and comprising a plate adapted to be affixed to mounting points of the equipment used for the support member, a lock device including a lock and a cable, the lock device being affixed to the plate, there being a restraining area about which the cable can be wrapped for storage of the cable on the equipment when the equipment is in use, the cable being releasable from the lock device and restraining area to allow the cable to be wrapped about a fixed object and secured back to the lock to thereby attach the sporting equipment to the fixed object to prevent or minimize theft of the sporting equipment, and the restraining area comprises a pad which includes a space between a surface of the sporting equipment and the pad thereby forming essentially an annular chamber within which the cable can be wrapped while the sporting equipment is in use.

21. A locking apparatus for sporting equipment such as a snowboard and the like having a support member for a boot or shoe, and comprising a plate adapted to be affixed to mounting points of the equipment used for the support member, a lock device including a lock and a cable, the lock device being affixed to the plate, there being a restraining area about which the cable can be wrapped for storage of the cable on the equipment when the equipment is in use, the cable being releasable from the lock device and restraining area to allow the cable to be wrapped about a fixed object and secured back to the lock to thereby attach the sporting equipment to the fixed object to prevent or minimize theft of the sporting equipment, the lock device includes recesses for normally capturing enlarged ends of the cable and so as to allow the cable to be removed from the lock device and sporting equipment.

22. A locking apparatus as in claim 21 wherein in the plate extends outwardly from underneath the support member along the surface of the snowboard, and the lock device is affixed to the outwardly extending portion of the plate.

23. A locking apparatus for sporting equipment such as a snowboard and the like having a support member for a boot or shoe, and comprising a plate adapted to be affixed to mounting points of the equipment used for the support member, a lock device including a lock and a cable, the lock device being affixed to the plate, there being a restraining area about which the cable can be wrapped for storage of the cable on the equipment when the equipment is in use, the cable being releasable from the lock device and restraining area to allow the cable to be wrapped about a fixed object and secured back to the lock to thereby attach the sporting equipment to the fixed object to prevent or minimize theft of the sporting equipment, and wherein the sporting equipment is a snowboard having a upper surface, the plate is mounted to the upper surface of the snowboard underneath the support member, the support member comprising a boot binding, and the outer edge of the plate includes an annular area comprising the restraining area about which the cable can be wrapped.

24. A locking apparatus as in claim 23 wherein the lock device has an upper surface forming a stomp pad.

* * * * *